US005213241A

United States Patent [19]

Dewar et al.

[11] Patent Number: 5,213,241

[45] Date of Patent: May 25, 1993

[54] SKI GOGGLE PROTECTIVE DEVICE

[75] Inventors: Jeffrey D. Dewar, 251 Hilltop Dr., Suite 124, Redding, Calif. 96003; Kenneth S. Janzen, Danville, Calif.

[73] Assignee: Jeffrey Donald Dewar, Redding, Calif.

[21] Appl. No.: 661,117

[22] Filed: Feb. 27, 1991

[51] Int. Cl.[5] ..... A45C 13/30; A45F 3/14

[52] U.S. Cl. ..... 224/222; 224/247; 224/267; 206/5; 248/902

[58] Field of Search ..... 224/222, 224, 267, 917, 224/227, 247, 253, 257, 258, 151, 152, 153, 205; 206/5, 315.1; 248/902; 2/452, 434, 13, 426–432, 2; 150/108

[56] References Cited

U.S. PATENT DOCUMENTS

| | | | |
|---|---|---|---|
| 1,612,741 | 12/1926 | Newman-Butler | 224/205 |
| 2,758,309 | 8/1956 | Baratelli | 2/452 |
| 2,949,609 | 8/1960 | Sager | 2/13 |
| 2,999,426 | 9/1961 | Hanke | 2/426 |
| 3,389,406 | 6/1968 | Mitchell | 2/434 |
| 3,458,866 | 8/1969 | De Man | 2/13 |
| 4,029,243 | 6/1977 | Zerobrick et al. | 224/224 |
| 4,051,554 | 10/1977 | Kallman | 224/901 |
| 4,520,510 | 6/1985 | Daigle | 2/426 |
| 4,556,995 | 12/1985 | Yamamoto | 2/439 |
| 4,606,453 | 8/1986 | Burns | 206/5 |
| 4,797,956 | 1/1989 | Boyce | 2/13 |
| 4,901,374 | 2/1990 | Van der Woude | 2/431 |
| 4,919,258 | 4/1990 | Perretta | 206/5 |
| 4,945,573 | 8/1990 | Landis | 2/13 |
| 4,953,695 | 9/1990 | Tallman | 206/5 |
| 4,965,887 | 10/1990 | Paoluccio et al. | 2/13 |
| 4,966,322 | 10/1990 | Zagorski et al. | 224/267 |

*Primary Examiner*—Henry J. Recla
*Assistant Examiner*—Glenn T. Barrett
*Attorney, Agent, or Firm*—Bernhard Kreten

[57] ABSTRACT

A protective device configured to accommodate snow ski goggles when the goggles are not to be used for vision purposes. The protective device includes a strap and a protective cover which collectively form a loop adapted to circumscribe a portion of an animate bearer, such as the bicep area of one's arm. The cover is provided with structure to engage the ski goggle in a secure manner so that the protective goggle in conjunction with the strap can be worn with the cover occluding an outer arcuate surface of the goggle.

17 Claims, 2 Drawing Sheets

SKI GOGGLE PROTECTIVE DEVICE

FIELD OF THE INVENTION

The following invention relates to protective devices which prevent marring of the translucent viewing surface of a ski goggle. The device is so constructed that the ski goggle can be placed within the protective device and the device is suitably configured to allow it to be carried on a body appendage, such as on an arm of the skier.

BACKGROUND OF THE INVENTION

Snow skiing is one of the more equipment intensive sports that are popular today. Apart from the essential elements that comprise ski equipment, such as skis, boots, and bindings, the skier also must carry other equipment in order to enhance the skiing experience. Poles, gloves, hats and goggles are just a few of the items that frequently attend the skier.

One of the hallmarks of skiing includes the variable conditions encountered by the skier during the course of ski activities. Because skiing frequently involves traversing terrain at disparate elevations, the skiing conditions at one elevation can be markedly different than those encountered at another elevation. Moreover, the inherent nature of alpine conditions makes it likely that ski conditions can change precipitously, even on a single area of one slope.

Several visibility conditions can be encountered during the course of a single run. Examples of varied visibility include "whiteouts", skiing in flat light, or skiing in bright sun. In order to competently manage these varied visibility conditions, many skiers carry several different types of vision enhancing devices, such as sun glasses and goggles.

While certain accessories can be placed in one's pockets, goggles provide a singular problem with respect to pocket storage because of their external geometrical configuration and relatively large size. Typically, goggles include a unitary transparent viewing panel which is circumscribed by a flexible frame with the frame having lateral extremities interconnected by a flexible band so that the goggles can be worn on the head with the flexible band circumscribing a rear portion of the persons head. When not in use, however, goggle storage is a problem.

If the goggles are to be left on an area of the person's head, for example around the neck, the viewing panel remains exposed to the elements and remains susceptible to marring should the skier fall which is a readily forseeable event. Even if the skier does not fall, location of the goggles around the neck can cause condensation on the goggles by the temperature differential induced by breathing on the cold transparent viewing panel during physical exertion. The goggles also restrict movement of the head. Additionally, because of their size, it is not comfortable to wear them around the neck, and a skier cannot zip up his jacket all the way because the goggles get in the way. If, on the other hand, the goggles are to be placed such that they are worn on top of the head, they are more readily vulnerable to abrasion and dislodgement. The strap tension may cause headaches or irritation if worn all day.

Some skiers will tend to obviate these noted deficiencies by wearing the goggles on a body appendage, such as one arm, in a way, such that the goggles circumscribe one's bicep. However, it is not comfortable to have the frame and viewing panel portion of the goggle interposed between the bicep and the rib cage because of the thickness of the frame. Thus, the goggle remains oriented on the outer surface of the arm, exposed and vulnerable to incidental contact with foreign objects. Because ski lines and chair lifts tend to encourage shoulder-to-shoulder contact, marring of the transparent viewing panel is more likely. Lifting skis over the shoulder can also cause the goggles to be scratched and it is difficult to make the strap tight enough to keep the goggles in place so they do not slide down toward the elbow. Even should the skier be extremely fastidious in avoiding incidental contact, the goggles are still vulnerable to moisture contact.

While some ski accessory manufacturers, cognizant of storage problems have provided waist-worn packs, these packs provide somewhat greater risk due to the locale of the packs on the body around the waist.

The following patents reflect the state of the art of which applicant is aware and are included herewith to discharge applicant's acknowledged duty to disclose known prior art. However, it is stipulated, that none of these references teach singly nor render obvious when considered in any conceivable combination the nexus of applicant's invention as particularly set forth hereinbelow and as claimed.

| INVENTOR | PATENT NO. | ISSUE DATE |
|---|---|---|
| Lee | 2,358,934 | Sept. 26, 1944 |
| Mitchell | 3,389,406 | June 25, 1968 |
| McGee et al | 3,945,044 | March 23, 1976 |
| Smith | 4,428,081 | Jan. 31, 1984 |
| Moretti et al | 4,542,538 | Sept. 24, 1985 |
| McNeal | 4,716,601 | Jan. 5, 1988 |
| Perretta | 4,919,258 | April 24, 1990 |

The patent to Perretta teaches the use of a protective enclosure for a driver's face mask. It includes a base panel of foam material attached to a sidewall enclosure complementary formed to the outer contour of a diver's mask and adapted to completely receive the mask therewithin. A cover is tethered to the base and secured in place with a locking enclosure tab. The strap of the mask secured within the case serves as the carrying handle for the case and mask.

The remaining patents show the state of the art further and diverge even more starkly from the instant invention.

SUMMARY OF THE INVENTION

The instant invention is distinguished from the known prior art in a plurality of ways. In one form of the invention, the device includes a cover which has, on upper and lower peripheral portions thereof, inwardly directed resilient flanges or locking fingers adapted to overlie the frame of the ski goggle. In this way, the cover occludes an exterior face of the goggle providing protection from the elements and scratching or damage once the goggles are placed into the cover and held by the locking fingers. The cover has lateral terminal extremities which terminate at approximately the same areas as the headband's termini commonly found on ski goggles. These lateral terminal extremities of the cover each support ends of a strap which, in conjunction with the cover, collectively form a loop having a dimension adapted to circumscribe a torso portion of an animate bearer by girding same. Typically, the torso portion of preference is the bicep area of the skier. By merely placing the cover over the goggles, and threading one's arm through the loop formed by the cover's strap and the cover, the goggles and the associated protective device can be worn even on the outside of one's arm without fear of marring the external face of the ski goggle.

In another form of the invention, the protective cover is embodied as a pouch having both a rear panel and a front panel. The front panel is formed from an upper and lower portion. The upper portion of the front panel is integrally formed with a top edge of the rear panel and the lower portion of the front panel is formed with a bottom edge of the rear panel. Side edges of the lower portion are also connected to the rear panel to form a pocket. The juncture between the upper and lower front panel portions is approximately half-way along the rear panel. The upper portion defines a flap and is free to move from a closed to an open position to receive the ski goggles within the pocket. Lateral extremities of the thus described pouch include a strap which in conjunction with the pouch form a loop as described above. In this variation, the pouch is not constricted to conform to the outer periphery of the ski goggle since the ski goggle itself is placed within the pocket of the pouch and contained therewithin by the flap. In both cases, however, a cover is provided for the exposed outer arcuate face of the goggle.

Assume a skier has encountered visibility conditions which obviate the need for the goggles. In such a case, the goggles can be removed from the skier's head, and secured to the device for subsequent skiing in a minimal amount of time while providing protection for the goggles.

OBJECTS OF THE INVENTION

Accordingly, it a primary object of the present invention to provide a novel and useful device for protecting and carrying ski goggles.

A further object of the present invention contemplates providing a device as characterized above which is extremely durable in construction, lends itself to mass production techniques, and is extremely safe to use.

A further object of the present invention is to provide a device as characterized above in which a skier, not having need for the goggles due to certain visibility conditions, can remove the ski goggles and place them in a protected environment yet still have the goggles readily accessible should that need rearise.

Viewed from a first vantage point, it is an object of the present invention to provide a device which allows an animate bearer to safely transport goggles of the type having a transparent viewing panel circumscribed by a flexible frame in which the frame has lateral extremities interconnected by a flexible band. A cover is dimensioned to overlie at least a portion of the viewing panel and a strap connects to the cover. Collectively the strap and the cover form a loop such that the device girds a part of the animate bearer.

Viewed from a second vantage point, it is an object of the present invention to protect ski goggles from damage when carried but not operatively worn by a skier which includes a cover that provides a barrier between the lens of the ski goggle and the environment, and a strap connected to the cover at outboard extremities thereof. The cover and strap form a loop so that the device is carried on the arm of the skier such that the cover protects the ski goggles from damage when the goggles are interposed between the cover and the arm of the skier.

Viewed from a third vantage point, it is an object of the present invention to provide a method for protecting ski goggles in transport by an animate bearer, the steps including: forming a protective cover which occludes at least a portion of the goggles, including a strap on the cover which when oriented collectively with the cover forms a loop, placing the cover on the goggles and wearing the protective cover on an appendage of the animate bearer.

These and other objects will be made manifest when considering the following detailed specification when taken in conjunction with the appended drawing figures.

DESCRIPTION OF THE DRAWINGS FIGURES

DESCRIPTION OF PREFERRED EMBODIMENTS

Figure 5:
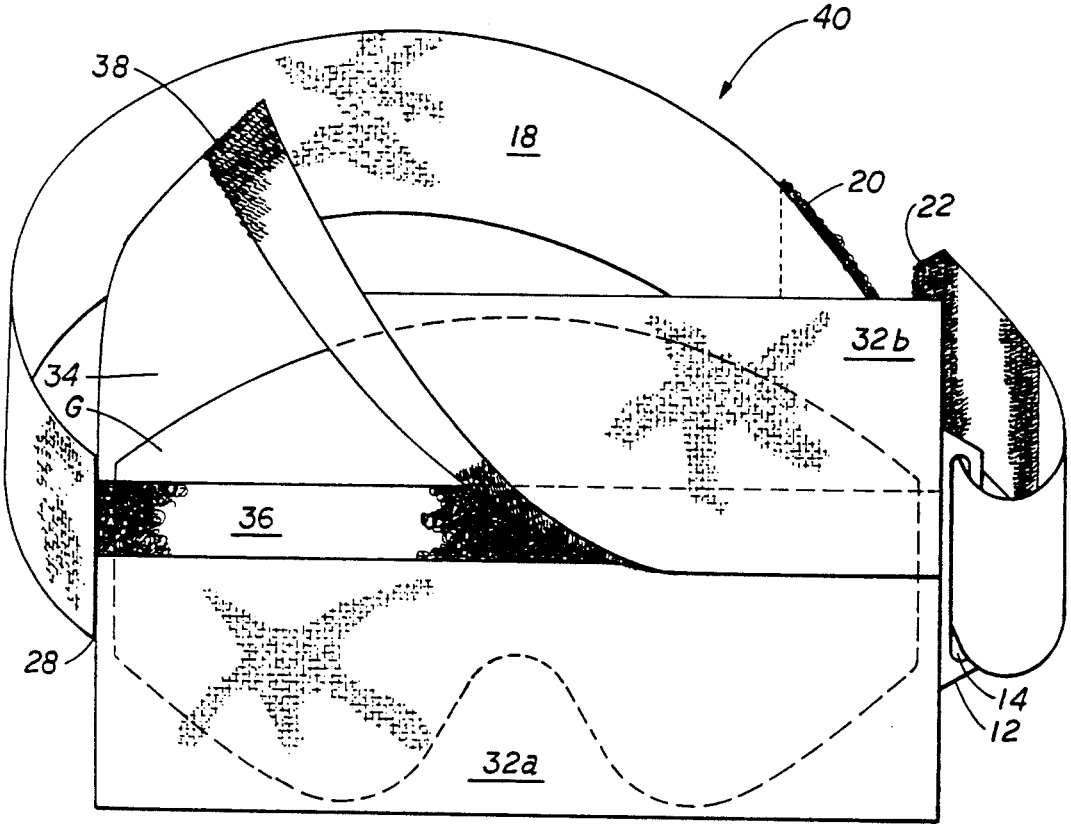
FIG. 5 is a perspective of the apparatus according to the present invention according to a second form.

Referring to the drawings now, wherein like reference numeral refer to like parts throughout the various drawing Figures, reference numeral 30 is directed to the ski goggle protective device according to one form of the invention and reference numeral 40 is directed to the ski goggle protective device according to a second form of the invention as shown in FIG. 5.

Figure 3:
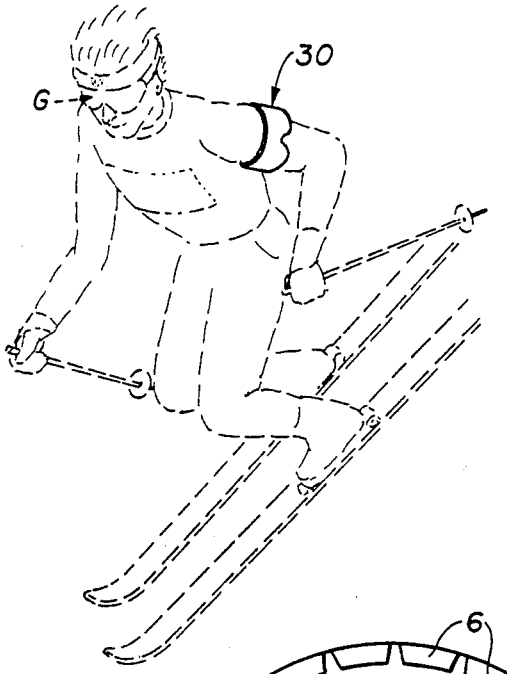
FIG. 3 is a perspective view of the apparatus according to the present invention in its deployed form.

In its essence, both devices include a portion which covers the goggles G, this cover portion having lateral extremities provided with a strap which, with the cover, collectively form a loop such that the strap and cover can be operated in concert to circumscribe a body portion, such as the bicep area of a skier as shown in FIG. 3.

More particularly, and with specific reference to FIGS. 1–4, the device 30 according to a first form can be explored in detail. In essence, a cover is provided having an outer surface 2 and an inner surface 4. Resilient locking fingers, 6, 8 attend top and bottom edges of the cover. By resilient locking fingers it is meant not only a biased retention means but also a peripheral support wall. As shown, upper resilient locking fingers 6 extend inwardly over the inner surface 4 of the cover. Similarly, lower resilient locking fingers 8 also extend inwardly over the inner surface 4 of the cover. Collectively, the upper and lower resilient locking fingers 6, 8 provide a gripping means which allows these fingers to contact an outer periphery of a frame of conventional goggles G. In this manner, the outer surface 2 of the cover is allowed to remain exposed while the inner surface 4 of the cover faces directly over an outer arcuate surface of a unitary transparent viewing panel found on most ski goggles. When thusly configured, this outer unitary transparent viewing panel of the goggle G has been protected.

Figure 1:
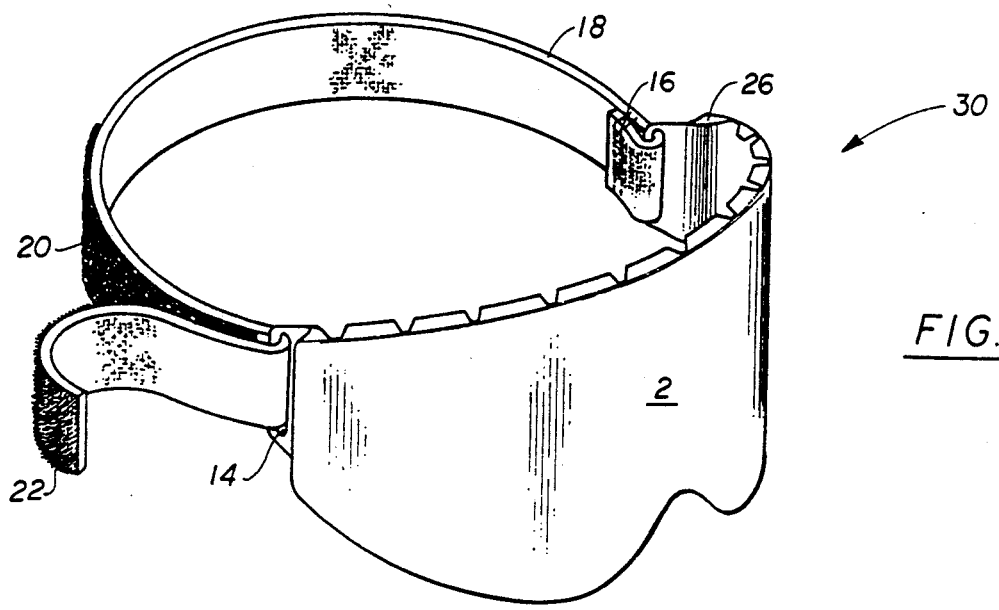
FIG. 1 is a perspective of the apparatus according to the present invention according to a first embodiment.
Figure 2A:
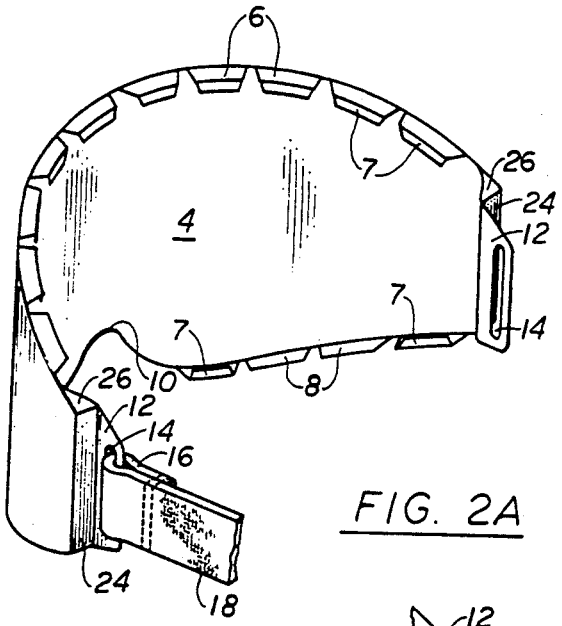
FIG. 2A is a rear perspective of a portion of that which is shown in FIG. 1.

An inner portion of the goggle G is also protected by its juxtaposition to a portion of a person's body. In order to effect same, the cover 2, 4 operates in concert with a strap 18 to circumscribe a portion of an animate bearer's torso such as the bicep of a skier shown in FIG. 3. In essence, the strap 18 has two extremities. One extremity is connected to a lateral edge of one side of the cover. Another extremity of the strap 18 is connected to a remote lateral edge of the cover. More specifically, one end of the strap 18 includes a folded over portion 16 which has been threaded through a strap eyelet 14 integrally formed in the cover. In this manner, when the strap end 16 has been folded over and stitched as shown in FIG. 1 and FIG. 2A, one end of the strap 18 will have been tethered to the cover 2, 4. An opposed extremity of the strap 18 has a terminal portion 22 provided with a fastener on one inner surface of the strap to coact with a second fastener 20 on another downstream outer portion of the strap 18. In a preferred form of the invention, the fasteners 20, 22 respectively form hook and eyelet fasteners available in the industry and commonly sold under the trade name Velcro TM.

In use and operation, the free end 22 of the strap 18 is threaded through another strap eyelet 14 and the strap 18 is doubled back on itself so that the male and female Velcro TM connecting portions 20, 22 can be frictionally interengaged.

Figure 2B:
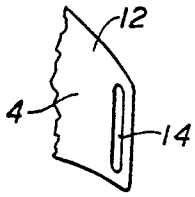
FIG. 2B is an alternative embodiment to that which is shown in FIG. 2A along one terminal extremity thereof.
Figure 4:
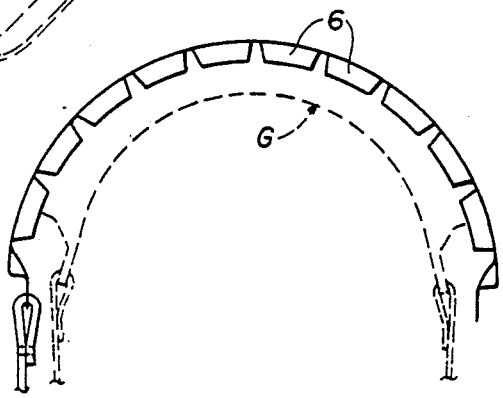
FIG. 4 is a top plan view of the apparatus according to the present invention.

Two forms of cover end structure are reflected in FIGS. 2A and 2B. In FIG. 2A, the strap eyelet 14 is configured as a vertically-oriented, longitudinally extending slit carried on a strap support tab 12 integrally formed with the cover. However, this strap support tab 12 is radially inset with respect to the major axis of curvature of the cover itself. One possible inset can take the form of a stepped shoulder 24 connected to the cover by means of a reinforcing gusset 26 of substantially triangular configuration. The gusset 26 provides strength at the area where the tab 12 steps down. A second form of tab support is shown in FIG. 2B where there is neither a stepped shoulder nor a gusset and the tab 12 appears as a smooth tapered transition from the cover 2, 4.

With respect to the upper and lower resilient locking fingers 6, 8 respectively, although a plurality of these fingers have been shown, these are merely illustrative and fewer or more fingers could be deployed depending upon the geometrical constraints associated with the goggle frame geometry. The fingers 6, 8 may include locking teeth 7 to assist in gripping the frame of the goggles. In addition, note the presence of a nose recess 10 along the bottom edge of the cover which may or may not interrupt the lower resilient locking fingers 8. The nose recess is intended to accommodate goggles which provide accommodation for one's nose in the form of an outwardly extending flair.

With respect to FIG. 5, only those salient differences which cause divergence between the earlier described version will be belabored. As shown in the drawings, the protective cover 40 is configured as a soft case for the goggles G and includes a rear panel 34 of substantially rectangular configuration having a longitudinal axis disposed in a substantially horizontal plane (merely for the purposes of further discussion). Upper and lower latitudinal edges of the rear panel are integrally formed with upper and lower portions, respectively, of a front panel 32.

More specifically, an upper front panel portion **32*b* extends downwardly from the upper latitudinal top edge of the rear panel while the lower front panel portion 32*a* extends upwardly from the lower latitudinal bottom edge of the rear panel. Marginal side portions of the lower front panel 32*a* may be stitched or otherwise fastened to the rear panel 34 to provide a form of pocket. Sufficient overlap between the upper 32*b* and lower 32*a* front panel portions provide a fastening element 36, 38** of conventional hook and eyelet configuration such as the product marketed under the name "Velcro TM", described above. This overlap applies especially when using Velcro. One might substitute clasps, which then no longer require but a small overlap.

Because of the soft case configuration, the goggle protector 40 according to a second form of the invention actually only requires one strap eyelet 14 extending from one vertical edge adjacent the rear panel and coupled thereto by means of a strap support tab 12. The other vertical edge of the rear panel 34 can fix the strap 18 thereto by means of seaming techniques as shown diagrammatically by joint 28.

In use and operation, the goggles G can be actually used such as suggested in FIG. 3. When not in use the goggles can be placed in the protective device 30 on the bicep of ones arm as shown in that drawing Figure, or the FIG. 5 version.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A device adapted for transporting a part of goggles on a limb of a user, said pair of goggles having a transparent viewing panel with an outer surface and an inner surface circumscribed by a flexible frame having a peripheral edge and lateral extremities interconnected by a flexible band, wherein the inner surface of the panel is oriented proximate the eyes user wherein use, of the said device comprising:

a cover having an outer periphery and is adapted to overlie and conform to at least a portion of the outer surface of the viewing panel, a plurality of resilient locking fingers positioned along said periphery of said cover and extending therefrom, said plurality of fingers being adapted to engage said pair of goggles to secure said cover to said pair of goggles; and a strap having a pair of ends connected to said cover such that said cover and said strap form a loop wherein the cover is adapted to receive said pair of goggles and said loop is adapted to surround a limb of the user such that said goggles are protectibly secured on the user for transporting when not in use.

2. The device of claim 1 wherein said cover has top and bottom edges provided with a plurality of inwardly directed projections including locking teeth defining said plurality of resilient locking fingers, said projections are adapted to overlie said peripheral edge of the frame such that said plurality of projections and plurality of locking teeth are adjacent to the peripheral edge of the frame when said cover is seconded to the goggles.

3. The device of claim 2 wherein said cover includes means for connecting said strap to said cover, said connecting means being located on one end of said cover and having a strap eyelet formed as part of an underlying support tab integral with said cover.

4. The device of claim 3 wherein one end of said strap is provided with fastening means whereby said one end of said strap is threaded through said eyelet and is doubled back upon itself, and an outboard surface of said strap coacts with an inboard free end of said strap for positive fastening.

5. The device of claim 4 wherein said fastening means includes a hook and eyelet fastener.

6. The device of claim 5 wherein an end of said strap remote from said one strap end is fixed to an opposite end of said cover.

7. The device of claim 6 wherein said opposite end of said cover includes a strap eyelet formed as part of an underlying support tab integral with said cover adapted to receive another end of said strap.

8. The device of claim 7 wherein each of said tabs extends substantially linearly from said cover.

9. The device of claim 8 wherein each of said taps includes a stepped shoulder such that said tabs are closer together than said opposite ends of said cover.

10. A device of claim 1:

wherein said strap is connected to said cover on a first lateral extremity through an underlying support tab and on a second lateral extremity through a tab, and wherein said tab is a substantially linear extension of said cover except where said tab is interrupted from said cover by means of a stepped shoulder causing said tab and said underlying support tab to be closer together than said first lateral extremity and said second lateral extremity of said cover.

11. The device of claim 10 wherein each of said stepped shoulder is reinforced by means of a gusset.

12. The device of claim 11 wherein said cover includes a lower edge provided with an upwardly extending relieved area adapted to accommodate a nose area on the goggle.

13. A device adapted for protecting an exterior surface of a pair of ski goggles from damage when carried but not operatively worn by a skier, wherein the exterior surface of the ski goggles is an outer surface of an optically transparent panel, an inner surface of said panel is juxtaposed to a skier's face when the goggles are worn, said device comprising a cover adapted to conform to the exterior surface of said pair of ski goggles and provide a barrier between the panel and the environment; a plurality of resilient locking fingers extending from top and bottom edges of said cover said plurality of fingers being adapted to engage said pair of goggles to secure said cover to said pair of goggles;

a strap having a pair of ends connected to said cover such that said cover and said strap form a loop such that the device is adapted to receive and carry a pair of ski goggles on a limb of the skier when not operatively worn by the skier, wherein the cover protects the exterior of the goggles from damage.

14. The device of claim 13 wherein said strap includes a longitudinal adjustment means allowing said strap to be lengthened or shortened.

15. A method for protecting a pair of goggles in transport on a user, said pair of goggles having an exterior surface, said method comprising:

forming a protective cover shaped to overlie a portion of the exterior surface of said pair of goggles; forming a plurality of resilient locking fingers on the cover; fastening a strap on the cover such that said cover and strap form a loop;

placing the cover on said pair of goggles such that the exterior surface of said pair of goggles is covered by the cover; and retaining the cover on said pair of goggles in a manner preventing movement of the goggles with respect to the cover by engaging the plurality of resilient locking fingers on said cover with said pair of goggles.

16. The method of claim 15 including placing the cover on a portion of a limb of a user.

17. A device adapted to allow a user to safely transport a pair of goggles having a transparent viewing panel circumscribed by a flexible frame having peripheral edges and lateral extremities interconnected by a flexible band said device comprising:

a cover adapted to overlie at least a portion of the viewing panel; and a strap having opposite ends connected to said cover such that said cover and said strap form a loop, wherein said cover has top and bottom edges provided with a plurality of inwardly directed resilient locking projections adapted to overlie said peripheral edges of the frame, wherein said cover include means on opposite ends of said cover for connecting said strap to said cover, said connecting means on each end of said cover having a strap eyelet formed as part of a tab integral with said cover, wherein each of said opposite ends of strap is provided with fastening means whereby one of said opposite ends of said strap is threaded through said eyelet on one end of said cover and is doubled back upon itself, and an outboard surface of said strap coacts with an inboard free end of said strap for positive fastening, and another of said opposite ends of said strap is threaded through said eyelet on an opposite end of said cover and is doubled back upon itself, and an outboard surface of said strap coacts with an inboard free end of said strap for positive fastening, wherein said fastening means includes a hook and eyelet fastener, and wherein each of said tabs on said connecting means includes a stepped shoulder such that said tabs are closer together than said opposite ends of said cover.

* * * * *